US008216627B2

(12) United States Patent
Ablett

(10) Patent No.: US 8,216,627 B2
(45) Date of Patent: Jul. 10, 2012

(54) PLANT WASTE BIO-PRODUCT POMACE EXTRACT CONCENTRATES AND PROCESSES OF PRODUCING SAME

(76) Inventor: Richard F. Ablett, Charlottetown (CA)

( * ) Notice: Subject to any disclaimer, the term of this patent is extended or adjusted under 35 U.S.C. 154(b) by 471 days.

(21) Appl. No.: 12/457,210

(22) Filed: Jun. 3, 2009

(65) Prior Publication Data

US 2009/0301969 A1 Dec. 10, 2009

Related U.S. Application Data

(60) Provisional application No. 61/129,075, filed on Jun. 3, 2008.

(51) Int. Cl.
*A23L 1/28* (2006.01)
*C12C 3/00* (2006.01)
*C11B 5/00* (2006.01)

(52) U.S. Cl. ..... 426/655; 210/638; 210/641; 210/652; 426/425; 426/427; 426/541; 426/590

(58) Field of Classification Search ..... None
See application file for complete search history.

(56) References Cited

U.S. PATENT DOCUMENTS 3,963,700 A * 6/1976 Philip ..... 536/4.1
4,452,822 A * 6/1984 Shrikhande ..... 426/49
4,775,477 A * 10/1988 Stahl et al. ..... 210/641
6,231,866 B1 * 5/2001 Mann ..... 424/732
6,544,581 B1 * 4/2003 Shrikhande et al. ..... 426/655
6,780,442 B2 * 8/2004 Bailey et al. ..... 424/732
7,208,181 B1 * 4/2007 King et al. ..... 424/725
7,270,837 B2 * 9/2007 Vorsa et al. ..... 424/732
7,288,272 B2 * 10/2007 Ochiai et al. ..... 424/766
7,427,418 B2 * 9/2008 Gaudout et al. ..... 424/765
7,462,370 B2 * 12/2008 Bailey et al. ..... 424/732
7,507,423 B2 * 3/2009 Wallace et al. ..... 424/725

* cited by examiner

*Primary Examiner* — Krishnan S Menon
*Assistant Examiner* — Dirk Bass
(74) *Attorney, Agent, or Firm* — The Nath Law Group; Jerald L. Meyer; Tanya E. Harkins

(57) ABSTRACT

A processes is provide herein for converting waste bio-product pomace to useful bio-product extracts. The process includes the steps of forming a mixture of water as a solvent and a specified quantity of the waste bio-product pomace. Then optionally adding a suitable quantity of citric acid to the water/waste bio-product mixture. Then heating waste bio-product pomace/water mixture to an elevated temperature below the boiling point of water. Then optionally adding a suitable quantity of sodium metabisulfite to the heated waste bio-product pomace/water mixture Then stirring heated waste bio-product pomace/water mixture for a suitable time to disperse the waste bio-product uniformly in the water solvent. Then cooling the stirred, heated waste bio-product pomace/water mixture to a suitable lower temperature at a rate of about 60° C. per hour. Then removing solids from the stirred waste bio-product pomace/water mixture. Then clarifying the cooled stirred water/waste bio-product mixture. Then concentrating the clarifying cooled stirred waste bio-product pomace/water mixture under the influence of a suitable vacuum and at a suitable increased temperature until the concentrate has a BRIX of about 20 to about 22. This provides a concentrated useful bio-product comprising antioxidant-enriched liquids comprised of the natural elements extracted from said waste bio-products.

20 Claims, No Drawings

PLANT WASTE BIO-PRODUCT POMACE EXTRACT CONCENTRATES AND PROCESSES OF PRODUCING SAME

BACKGROUND OF THE INVENTION

1. Field of the Invention

This invention relates to processes for converting plant waste pomace (of, e.g., blueberries, cranberries, Saskatoon berries, bilberries, boysenberries, marionberries, chokeberries, loganberries, boysenberry, tayberries, gooseberries, blackberries, raspberries, alderberries, huckleberries, crowberries, strawberries, mulberries, grape, apple, etc.,) to concentrated antioxidant-enriched liquids comprised of the natural elements extracted from the respective plant waste pomace. This application claims priority on a US provisional patent application (Ser. No. 61/129,075) filed Jun. 3, 2008, the entire contents of which are herein incorporated by reference.

2. Description of the Prior Art

One of the main residual materials arising from juice pressing activities of berries e.g., e., blueberries, cranberries, Saskatoon berries, bilberries, boysenberries, marionberries, chokeberries, loganberries, boysenberry, tayberries, gooseberries, blackberries, raspberries, alderberries, huckleberries, crowberries, strawberries, mulberries, grape, apple, etc., is "pomace" which is herein defined as consisting primarily of the skins, seeds and exhausted pith of the pressed berries. The pomace has been shown to contain significant amounts of valuable molecules identified as anti-oxidants. One of the main problems in retaining these valuable molecules is that they are highly reactive in numerous naturally occurring environments. One means of extracting and capturing the residual anti-oxidant molecules remaining in the pomace with minimal denaturing is to use an acidified aqueous solution as a solvent in conjunction with a series of separators and varying temperature/pressure vessels.

Among the patents relating to the extraction and capturing of the residual anti-oxidant molecules remaining in the plant waste "pomace" are the following:

U.S. Pat. No. 7,507,423 issued Mar. 24, 2009, to Biorex Health Limited (Australia), which teaches extracting flavenoids from plant wastes of, e.g., soya beans, chick peas, subterranean clover, lupines, lupinus albus seeds, etc., using enzymatic conversion.

U.S. Pat. No. 7,462,370 issued Dec. 9, 2008, to Phenolics LLC (Omaha, Nebr.), which teaches the extraction of anthocyanins from plant waste materials of, e.g., blueberries, bilberries, boysenberries, marionberries, cranberries, strawberries, raspberries, etc, using an extractant consisting of a sulfuric acid/ethanol solvent.

U.S. Pat. No. 7,427,418 issued Sep. 23, 2008, to Diana Ingredients SA, (France), which teaches extracting phloridzin-rich phenols from fruit of the Rosaceae family, e.g., apple, using solid/liquid extraction followed by enzymatic liquefaction.

U.S. Pat. No. 7,288,272 issued Oct. 30, 2007, to Ochiai et al (Napa, Calif.), which teaches the essential step of germination of dried grape seeds to obtain water-soluble polyphenols.

U.S. Pat. No. 7,270,837 issued Sep. 18, 2007, to Rutgers, The State University of New Jersey, which teaches the extraction of phenoloic fractions from freeze-dried cranberries by extraction with ethanol followed by extraction with ethyl acetate.

U.S. Pat. No. 7,208,181 issued Apr. 24, 2007, to The United States of America as represented by the Secretary of Agriculture, which teaches the extraction of anthrocyanins from fruit or highly pigmented garden vegetables, e.g., chokeberry, loganberry, boysenberry, tayberry, gooseberry, blackberry, raspberry, alderberry, huckleberry, crowberry, strawberry, mulberry, apple, lemon, orange, grapefruit, beet, carrot, red cabbage, etc., using sub-critical water.

U.S. Pat. No. 6,780,442 issued Aug. 24, 2004, to Hauser Inc (El Segunda, Calif.), which teaches the extraction of anthocyanins from plant residues of, e.g., blueberries, bilberries, boysenberries, marionberries, cranberries, strawberries, raspberries, etc using an acidified aqueous ethanol extraction followed by passage through a column loaded with a brominated polystyrene resin as an adsorbent resin.

U.S. Pat. No. 6,544,581 issued Apr. 8, 2003, to Canandigua Wines, which teaches extraction of phenolic substances from grapes, grape seeds and grape pomace using a hot water extraction followed by passage through a column loaded with a copolymer of trimethylpropane trimethylacrylate as an adsorbent resin.

Despite the teachings of the above prior art the need therefore exists to provide an economical process for converting waste bio-products of, e.g., blueberries, cranberries, Saskatoon berries, grapes, bilberries, boysenberries, marionberries, apple etc. into useful bio-product extracts which consist of concentrated antioxidant-enriched liquids comprised of the natural elements extracted from the respective waste bio-products.

Therefore, it is a general aim of the present invention to provide processes for satisfying the above need.

The invention in its general form will first be described, and then its implementation in terms of specific embodiments will be detailed with reference to the drawings following hereafter. These embodiments are intended to demonstrate the principle of the invention, and the manner of its implementation. the invention in its broadest sense and more specific forms will then be further described, and defined, in each of the individual claims which conclude this specification

SUMMARY OF THE INVENTION

Statement of Invention

One broad aspect of the present invention provides a process for converting waste bio-products pomace to useful bio-products, which comprises: forming a mixture of water as a solvent and a specified quantity of the waste bio-product pomace; optionally adding a suitable quantity of citric acid to the waste bio-product pomace/water mixture; heating the waste bio-product pomace/water mixture to an elevated temperature below the boiling point of water; optionally adding a suitable quantity of sodium metabisulfite to the heated waste bio-product pomace/water mixture; stirring said heated waste bio-product pomace/water mixture for a suitable time to disperse the waste bio-product pomace uniformly in the water solvent; cooling the stirred, heated waste bio-product pomace/water mixture to a suitable lower temperature at a rate of about 60° C. per hour; removing solids from the stirred waste bio-product pomace/water mixture; clarifying the cooled stirred waste bio-product pomace/water mixture; concentrating the clarifying cooled stirred waste bio-product pomace/water mixture under the influence of a suitable vacuum and at a suitable increased temperature until the concentrate has a BRIX of about 20 to about 22; thereby to provide a concentrated useful bio-product comprising antioxidant-enriched liquids comprised of the natural elements extracted from said waste bio-products.

Other Features of the Invention

One feature of the present invention is the selection of the waste bio-product as blueberries, cranberries, Saskatoon berries, bilberries, boysenberries, marionberries, chokeberries, loganberries, boysenberry, tayberries, gooseberries, blackberries, raspberries, alderberries, huckleberries, crowberries, strawberries, mulberries, grape, apple, etc.

Another feature of the present invention, when the waste bio-product is blueberry is the addition of about 10% to about 42% of blueberry pomace to the water solvent.

Another feature of the present invention, when the waste bio-product is blueberry, is the addition of less than 50 g of citric acid to the blueberry pomace/water mixture.

Another feature of the present invention, when the waste bio-product is blueberry, is the heating of the blueberry pomace/water mixture to a temperature of about 75° C. to about 85° C.

Another feature of the present invention, when the waste bio-product is blueberry, is the addition of about 500 g or less of sodium metabisulfite to the heated blueberry pomace/water mixture.

Another feature of the present invention, when the waste bio-product is blueberry, is the stirring of the blueberry pomace/water mixture at a temperature of about 75° C. to about 85° C. for up to 60 minutes.

Another feature of the present invention, when the waste bio-product is blueberry, is the cooling of the stirred blueberry pomace/water mixture from a temperature of about 75° C. to about 85° C. to a temperature of about 30° C. to about 40° C.

Another feature of the present invention, when the waste bio-product is blueberry, is the removal of the solids from the stirred blueberry pomace/water mixture by means of screening. A special feature of this feature is the pressing of the solids retained on the screen to provide expressed liquid and to add such expressed liquid to the stirred blueberry pomace/water mixture.

Another feature of the present invention, when the waste bio-product is blueberry, is the clarifying of the screened stirred blueberry pomace/water mixture by means of passing through a diatomite filter in conjunction with a cellulose filter.

Another feature of the present invention, when the waste bio-product is cranberry is the addition of about 10% to about 42% of cranberry pomace to the water solvent.

Another feature of the present invention, when the waste bio-product is cranberry, is the heating of the cranberry pomace/water mixture to a temperature of about 55° C. to about 65° C.

Another feature of the present invention, when the waste bio-product is cranberry, is the addition of about 0.005% or more by volume of a pectic enzyme to the water/cranberry mixture to carry out an enzymatic pre-extraction phase on the cranberry pomace/water mixture.

Another feature of the present invention, when the waste bio-product is cranberry, is the addition of less than 50 g of citric acid and the addition of less than 500 g of sodium metabisulfite to the cranberry pomace/water mixture.

Another feature of the present invention, when the waste bio-product is cranberry, is the stirring of the cranberry pomace/water mixture at a temperature of about 75° C. to about 85° C. for up to about 60 minutes.

Another feature of the present invention, when the waste bio-product is cranberry, is the cooling of the stirred cranberry pomace/water mixture from a temperature of about 75° C. to about 85° C. to a temperature of about 30° C. to about 40° C.

Another feature of the present invention, when the waste bio-product is cranberry, is the removal of the solids from the stirred cranberry pomace/water mixture by means of screening in conjunction with bentonite infusion. A special feature of this feature is the pressing of the solids retained on the screen to provide expressed liquid and to add the expressed liquid to the stirred cranberry/water mixture Another feature of the present invention, when the waste bio-product is cranberry, is the incubation of the of the solids from the screened, bentonite-infused cranberry pomace/water mixture for about 8 hours to about 18 hours at ambient temperature.

Another feature of the present invention, when the waste bio-product is cranberry, is the clarifying of the screened stirred cranberry pomace/water mixture by means of passing through a diatomite filter in conjunction with a cellulose filter.

The foregoing summarizes the principal features of the invention and some of its optional aspects. the invention may be further understood by the description of the preferred embodiments, which now follow.

DESCRIPTION OF PREFERRED EMBODIMENTS

Example 1

Production of Blueberry Extract 1000 liters of potable water is heated to 55 degrees Celsius in a sufficiently sized extraction vessel. Subsequently, between 120 kg (10.7% by weight) and 480 kg (42% by weight) of thawed blueberry pumice is added to the potable water solvent in the extraction vessel. Immediately following the addition of the blueberry pomace, 500 g of pre weighed citric acid is added to extraction vessel. Following the addition of the citric acid, the temperature of the extraction vessel is increased to 80+/−3 degrees Celsius. Once the contents of the extraction vessel have reached the desired temperature, 20 g of sodium metabisulfite are added to the mixture. This pomace mixture in the extraction vessel is held at 80+/−3 degrees Celsius for 60 minutes while continuous stirring is taking place inside the vessel. Once 60 minutes at the desired temperature and stir rate has elapsed, a cooling process is commenced until this pomace mixture in the extraction tank reaches 35° Celsius (at a desired rate is 60°/hr). Once the pomace solution has reached the desired cooled temperature, it is necessary to remove all remaining solids in solution by means of a screening process. The contents of the extraction tank are passed through a screen whereby the effluent and all dissolved compounds pass through the screen into a secondary holding vessel and all insoluble matter in the mixture larger than the screen gauge are removed. All of the insoluble matter collected from the screening process is pressed to collect all residual effluent which is then added to the majority volume of screened effluent referred to as "thin extract" in the secondary holding vessel. Following the screening process, a filtration process is executed whereby the screened thin extract is passed through a diatomite filter (Dicalite™) in conjunction with a cellulose filter aid (Solkafloc™) in order to achieve maximum clarity. Following the filtration, the screened and filtered thin extract containing 1-4% solids in solution (depending on the original pomace starting volumes), is then moved to a holding vessel. The subsequent step in the process is a concentration of the thin extract. In order to minimize denaturing of the anticipated antioxidant molecules arising, a condenser vessel capable of creating a vacuum is used in order to remove water in a reduced temperature environment. Concentration procedures are performed by transferring the thin extract into the condenser vessel, introducing a vacuum and increasing the temperature of the vessel. The BRIX levels in the vessel are continuously monitored in order to ensure concentration is occurring. The vacuum and temperature settings are maintained until desired BRIX of 20-22 is achieved. Once such desired BRIX is achieved "blueberry concentrate" is moved to collection vessel.

Example 2

Production of Cranberry Extract 1000 liters of potable water is heated to 55° Celsius in an extraction vessel. Subsequently 120 kg (10% by weight)-480 kg (42% by weight) of thawed cranberry pomace is added to the water solvent in a suitable extraction vessel. The temperature of the solvent and pomace in the extraction vessel is then increased to 60° Celsius. Once the desired temperature is achieved and due to the fibrous nature of cranberry pomace, pectic enzyme (Klerzyme™) is added to the extraction mixture in a suitable volume to achieve an enzymatic pre-extraction treatment phase. Once the pectic enzyme has been added, the cranberry pomace slurry is maintained for 30-60 minutes at 60° Celsius while continuously stirring. Upon conclusion of the enzyme treatment, 500 g of pre-weighed citric acid and 20 g of pre weighed sodium metabisulfite are added to extraction vessel. Following the addition of citric acid and sodium metabisulfite, the temperature of the extraction vessel is immediately increased to 80+/−3° Celsius. The cranberry pomace mixture in the extraction vessel is held at that temperature for 60 minutes while continuous stirring is taking place inside the vessel. Once 60 minutes at that desired temperature and stir rate has elapsed, a cooling process is commenced until the cranberry pomace mixture in the extraction tank reaches 35° Celsius (at a desired cooling rate of 60° C./hr). Once the cranberry pomace solution has reached the desired cooling temperature it is necessary to remove all remaining solids in solution by means of a screening process. The contents of the extraction tank are passed through a screen whereby the solvent and all dissolved compounds pass through the screen into a secondary holding vessel and all insoluble matter in the mixture larger than the screen gauge are removed. During this process, a prepared bentonite clarifying agent is added to the aqueous effluent fraction of the mixture as it is passed through the filter. All of the insoluble matter collected from the screening process is pressed to collect all residual solvents which are then added to the majority volume of screened effluent, referred to as "thin extract" in the secondary holding vessel. Following the screening process and the bentonite infusion, the thin extract is incubated for no less then 8 hours and no more than 18 hours at ambient temperature (15° Celsius). Following the incubation period a filtration process is executed whereby the screened thin extract is decanted and passed again through the screen and then subsequently through a diatomite filter (Dicalite™) in conjunction with a cellulose filter aid (Solkafloc™) in order to achieve maximum clarity. Following the filtration, the screened and filtered thin extract containing 1-4% solids in solution (depending on the original cranberry pomace starting volumes), is then moved to a holding vessel. The subsequent step in the process is a concentration of the clarified thin extract. In order to minimize denaturing of the anticipated anti oxidant molecules arising, a condenser vessel capable of creating a vacuum is used in order to remove water in a reduced temperature environment. Concentration procedures are performed by transferring the clarified thin extract into the condenser vessel, introducing a vacuum and increasing the temperature of the vessel. The BRIX levels in the vessel are continuously monitored in order to ensure concentration is occurring at an appropriate rate. Vacuum and temperature settings are maintained until desired BRIX of 20-22 is achieved. Once this desired BRIX is achieved "cranberry concentrate" is moved to collection vessel.

CONCLUSION

The described processing of blueberry pomace and cranberry pomace have been demonstrated to result in naturally derived concentrate liquids containing significantly elevated levels of valuable antioxidant components when compared relatively to whole such berries and other naturally derived products.

The foregoing has constituted a description of specific embodiments showing how the invention may be applied and put into use. These embodiments are only exemplary. The invention in its broadest, and more specific aspects is further described and defined in the claims which follow. These claims, and the language used therein are to be understood in terms of the variants of the invention which have been described. They are not to be restricted to such variants, but are to be read as covering the full scope of the invention as is implicit within the invention and the disclosure that has been provided herein.

The invention claimed is:

1. A process for converting fruit pomace to useful bio-products which comprises:

Forming a mixture of water as a solvent and a specified quantity of fruit pomace;

Adding a suitable quantity of citric acid to said mixture;

Heating said mixture to an elevated temperature below the boiling point of water;

Adding a suitable quantity of sodium metabisulfite to said heated mixture;

Stirring said heated mixture for a suitable time to disperse said fruit pomace uniformly in said water solvent;

Cooling said stirred, heated mixture to a suitable lower temperature at a rate of about 60° C. per hour;

Removing solids from said stirred mixture;

Clarifying said cooled stirred mixture;

Concentrating said clarified cooled, stirred mixture under the influence of a suitable vacuum and at a suitable increased temperature until the concentrate has a BRIX value of about 20 to about 22 thereby to provide a concentrated useful bio-product comprising antioxidant-enriched liquids comprised of the natural elements extracted from said fruit pomace.

2. The process of claim 1, wherein said fruit pomace is blueberry pomace.

3. The process of claim 2, comprising the addition of about 10% by weight to about 42% by weight of blueberry pomace to said water solvent.

4. The process of claim 2, including the addition of about 50 g or less of citric acid to the blueberry/water mixture.

5. The process of claim 2, including the heating of the blueberry pomace/water mixture to a temperature of about 75° C. to about 85° C.

6. The process of claim 2, including the addition of about 500 g or less of sodium metabisulfite to the heated blueberry pomace/water mixture.

7. The process of claim 2, including the stirring of the blueberry pomace/water mixture at a temperature of about 75° C. to about 85° C. for up to about 60 minutes.

8. The process of claim 2, including the cooling of the stirred blueberry pomace/water mixture from a temperature of about 75° C. to about 85° C. to a temperature of about 30° C. to about 40° C.

9. The process of claim 2, including the removal of the solids from the stirred blueberry/water mixture by means of screening, and optionally pressing of the solids retained on the screen to provide expressed liquid and to add such expressed liquid to the stirred blueberry/water mixture.

10. The process of claim 2, including the clarifying of the screened stirred blueberry/water mixture by means of passing through a diatomite filter in conjunction with a cellulose filter.

11. The process of claim 1, wherein said fruit pomace is cranberry pomace.

12. The process of claim 11, comprising the addition of about 10% by weight to about 42% by weight of cranberry pomace to said water solvent.

13. The process of claim 11, including the heating of the cranberry pomace/water mixture to a temperature of about 55° C. to about 65° C.

14. The process of claim 11, including the addition of about 0.005% or more by volume of a pectic enzyme to the cranberry pomace/water mixture to carry out an enzymatic pre-extraction phase on the cranberry/water mixture.

15. The process of claim 11, including the addition of about 50 g or more of citric acid and the addition of about 500 g or more of sodium metabisulfite to the cranberry pomace/water mixture.

16. The process of claim 11, including the stirring of the cranberry pomace/water mixture at a temperature of about 75° C. to about 85° C. about 60 minutes or less.

17. The process of claim 11, including the cooling of the stirred cranberry pomace/water mixture from a temperature of about 75° C. to about 85° C. to a temperature of about 30° C. to about 40° C.

18. The process of claim 11, including the removal of the solids from the stirred cranberry/water mixture by means of screening in conjunction with bentonite infusion, and optionally pressing of the solids retained on the screen to provide expressed liquid and to add the expressed liquid to the stirred cranberry/water mixture.

19. The process of claim 11, including the incubation of the of the solids from the screened, bentonite-infused cranberry pomace/water mixture for about 8 hours to about 18 hours at ambient temperature.

20. The process of claim 11, including the clarifying of the screened stirred cranberry pomace/water mixture by means of passing through a diatomite filter in conjunction with a cellulose filter.

* * * * *